United States Patent [19]

Wright

[11] 4,369,534

[45] Jan. 25, 1983

[54] CENTER REINFORCED MATTRESS

[76] Inventor: Ronald E. Wright, P.O. Box 245, Jasper, Mo. 64755

[21] Appl. No.: 199,052

[22] Filed: Oct. 20, 1980

[51] Int. Cl.[3] ..... A47C 23/04; A47C 23/05

[52] U.S. Cl. ..... 5/475; 5/263; 5/309; 5/478; 267/95; 267/105

[58] Field of Search ..... 5/475, 478, 263, 267, 5/309; 267/90, 95, 105

[56] References Cited

U.S. PATENT DOCUMENTS

| | | | |
|---|---|---|---|
| 1,717,949 | 6/1929 | Stubinz | 5/478 |
| 2,013,573 | 9/1935 | McNally | 5/267 |
| 2,131,071 | 9/1938 | Raduns | 5/267 |
| 2,247,543 | 7/1941 | Bernstein | 5/475 |
| 2,311,256 | 2/1943 | Sark | 5/267 |
| 2,962,088 | 11/1960 | Gleason | 5/478 |
| 4,122,566 | 10/1978 | Yates | 5/267 |
| 4,180,877 | 1/1980 | Higgins | 5/478 |

*Primary Examiner*—Alexander Grosz

*Attorney, Agent, or Firm*—Wood, Herron & Evans

[57] ABSTRACT

A mattress spring assembly is disclosed having increased firmness in a preselected center area of the mattress. This increased firmness is achieved through use of a grid structure attached to the opposite sides of the mattress. This grid structure comprises plastic straps extending diametrically across the mattress in the center third area and overlaid by a preformed wire grid. The plastic straps and wire grid are attached to the preassembled spring core by conventional connectors such as metal clips and/or hog rings.

3 Claims, 4 Drawing Figures

CENTER REINFORCED MATTRESS

This invention relates to spring units and more particularly to mattress spring units.

Mattress spring units are generally fabricated of a plurality of individual springs, e.g. coil springs, organized in matrix like fashion into columns and rows. These springs are held in spacial relation relative one to the other, i.e. the columns and rows of the matrix are restrained in fixed relation relative one to the other, in the finished mattress by some form of fastener device that interconnects adjacent springs throughout the matrix. After fabrication of the spring unit itself, manufacture of the finished mattress product is conventionally completed by placing a cushion or pad of material, e.g. woven or non-woven batting, or foam rubber, or the like, over the top and bottom surfaces of the spring unit matrix so formed. The padded structure is then enclosed with an upholstered fabric or cloth sheet or the like to provide the saleable mattress product.

In the bedding industry, i.e. the mattress and box spring industry, customer demand and preference in recent years has been for greater firmness in both mattresses and supporting box springs. There are a couple of different basic approaches which have been used to increase the firmness of a mattress. One approach is simply to increase the number of springs, i.e., the coil count, within the unit. Another approach has been to increase the gauge from which the springs within the bedding are fabricated. However, both of these approaches result in increased fabrication costs; in the first instance because of the increased number of coils required in the spring unit, and in the second instance because of the increased wire required to increase the wire gauge for each of the coils in the spring unit.

More recently, and as disclosed in U.S. Pat. No. 4,180,877, a further approach has been in commercial use. This approach involves the application of a welded wire grid overlaid on the top and bottom surfaces of the mattress. This welded wire grid is provided with a number of row wires generally equal to the number of spring rows in the unit and a number of column wires, the column and row wires being welded one to another at numerous intersections or cross-over points of these wires, thereby giving rise to the reference phrase of welded wire grid. The welded wire grid is connected to the top and bottom surfaces of the spring unit or mattress by suitable connectors such as hog rings.

It has been a primary objective of this invention to provide an improved mattress in which the center third of the mattress area, on both sides of the mattress, is provided with increased firmness relative to the remainder of the mattress surface, through use of a novel grid structure.

In accordance with this objective the improved mattress of this invention incorporates a novel grid structure on both sides of the mattress. This novel grid structure comprises diagonally extending crossed plastic straps overlaid by a pair of opposed generally M-shaped wire grids. This grid assembly is attached to the top and bottom surfaces of the mattress by a combination of wire clips and hog rings.

The primary advantage of this invention is that it achieves increased firmness in the center third of the mattress area in a manner which is economical to manufacture, which accommodates manufacturing variation in width of the spring units, and which is substantially "noise" free.

These and other objects and advantages of this invention will be more readily apparent from the following detailed description of the drawings in which.

Figure 1:
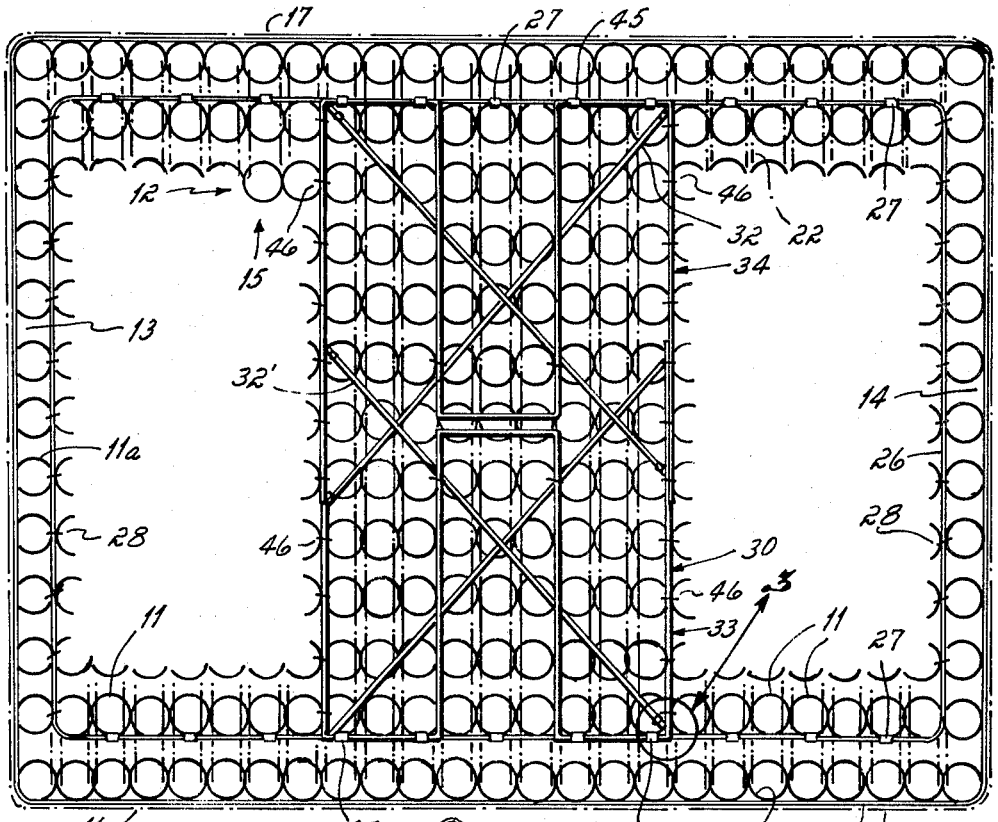
FIG. 1 is a top plan view, partially broken away, of a mattress spring assembly incorporating the invention of this application.
Figure 2:
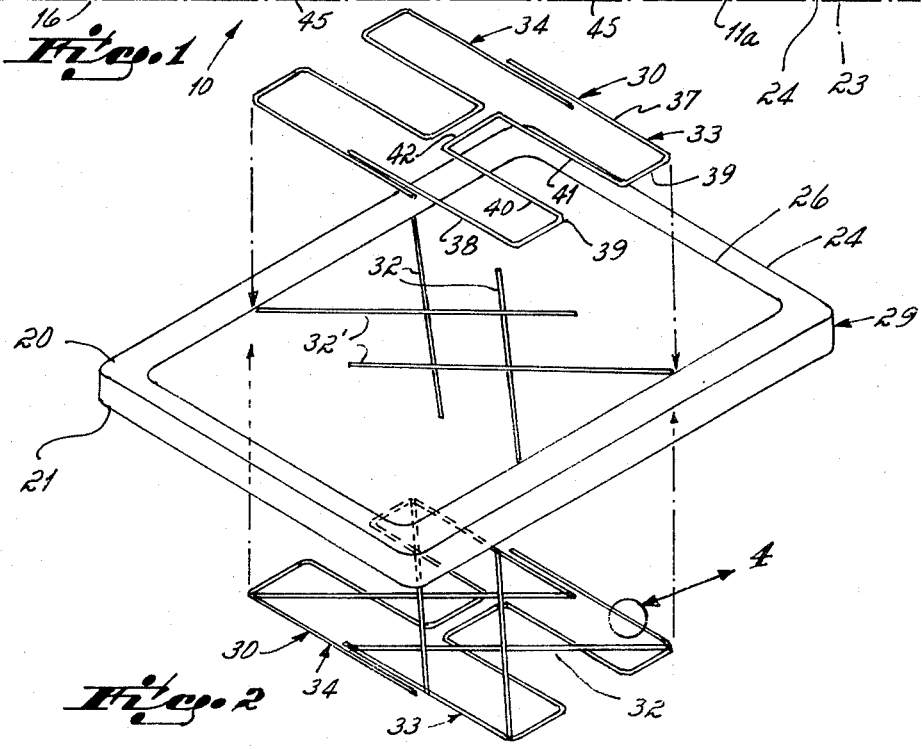
FIG. 2 is a partially diagrammatic, exploded perspective view of the mattress spring assembly.

In the drawings there is illustrated an improved mattress 10 incorporating the invention of this application. This mattress 10 comprises a number of coil springs 11 arranged in a matrix, the coil spring matrix defining thriteen columns 12 extending from one end edge 13 to the other end edge 14 of the mattress and twenty-five rows 15 extending from one side edge 16 to the other side edge 17 of the mattress. The coil springs 11 are of the ordinary double cone or hourglass type (not shown in detail). Each of the coil springs 11 includes a circular top loop 18 and a circular bottom loop, all of the circular top loops being oriented in the same basic horizontal plane to define the top surface 20 of the mattress and all of the bottom loops being arranged in the same basic horizontal plane to define the bottom surface 21 of the mattress. Although FIG. 1 illustrates only the top horizontal surface 20 of the mattress 10, it will be understood by those skilled in the art that the bottom surface 21 of the mattress is structurally identical to the top surface.

The matrix of coil springs 11 is connected together in matrix configuration in both the top surface and bottom surface of the mattress in conventional fashion as by helical springs 22 which connect adjacent coil spring rows 15 togehter one with the other. There is also a helical spring connector 23 wrapped around a border wire 24 and the border springs 11*a* to define the periphery of the mattress spring assembly. The mattress border wire 24 is simply a length of wire extending around the outer border periphery of the spring matrix in the top plane 20 of the spring assembly matrix. This border wire 23 is connected to the outer segments of the border springs' top loop 18 in the top plane 20 by a helical lacing wire 23 which is wrapped around the border wire and the adjacent spring loop segments throughout the length of the border.

The helical connectors 22 which interconnect the adjacent coil springs 11 of adjacent rows extend for the length of the row and are wrapped around the top loops of these coils. The connectors terminate just short of the outer border wire 23 where a reverse twist is bent into the end of each helical 22 as is conventional in many commercial mattresses.

The bottom plane of the mattress (not shown) is provided with the same border wire 24, helical lacing wire 23, and helical connecting wires 22 interconnecting the bottom loops of the coils 11 in the bottom plane as has been described for the mattress top plane 20.

Spaced inwardly from the outer border wire 24, there is a generally rectangular inner border wire 26. This inner border wire extends generally parallel to the outer border wire 24 but is spaced inwardly from that outer border wire. On its long sides the inner border wire is attached to the top loops of the coil springs by metal clips 27 and on its short sides by hog rings 28.

The spring matrix 29 heretofore described including the outer and inner border wires 24 and 26 as well as the connectors for connecting those border wires to the spring matrix, per se form no part of the invention of this application. This much of the mattress 10 is old and well-known in the prior art and has long been in commercial use. The invention of this application rather resides in the grid assembly 30 which is attached to the top and bottom surfaces 20, 21 of the mattress to increase the firmness of the center one-third surface area of the mattress. There are two such grid assemblies 30, one being attached to the top surface of the mattress and the other attached to the bottom surface.

Each grid assembly 30 comprises generally diagonally extending crossed plastic straps 32, 32' overlaid by a pair of wire grid elements 33, 34.

In the preferred embodiment illustrated in the drawings there are four diagonally extending straps 32, two of which extend diagonally in one direction and the other two 32' of which extend diagonally in the other direction and across the first two 32. In the preferred embodiment these straps are made from ⅜" wide strips of polypropylene plastic material.

The wire grid elements 33, 34 are mounted on top of the plastic straps. Each of these grids is generally U-shaped and has a pair of side legs 37, 38 interconnected by a center web section 39. The center web section 39 has a portion offset inwardly at the center so as to define a pair of legs 40, 41 interconnected by a center web 42. The overall configuration then of the wire grid is that of an "M" in which all of the angles are bent at right angles.

The two grid elements 33, 34 on each side of the mattress are mounted in opposed relation with the legs 37, 38 of one grid 33 overlapping the legs 37, 38 of the other grid 34. The wire grid is made in two sections in this manner, with the legs overlapping so as to enable the assembled grid to accommodate manufacturing variances in the width of the spring matrix. Quite commonly these spring matrixes vary in width by as much as ½ to 1" and in the absence of the two-piece grid element the wire grid when attached to the coil matrix would tend to either bow or expand the matrix depending upon the size of the matrix. Because the wire grids though are made in two sections they accommodate varying widths of mattresses without effecting any distortion of the spring matrix.

Figure 4:
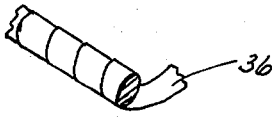
FIG. 4 is a perspective view of an encircled portion of the wire grid of FIG. 2.

As may best be seen in FIG. 4, the grid elements 33, 34 are wrapped for the full length of the grid element with a paper wrapping. In the preferred embodiment this paper wrapping comprises a kraft paper 36 which is helically would around the metal wire for the full length of the wire. This paper is adhered to the wire and is wrapped in overlapping fashion so that there is no tendency for the metal wire to become unwrapped or for the paper to become loosened on the metal wire.

The straps 32 are preferably manufactured from a plastic material and the wire grid elements 33, 34 are wrapped in paper in order to prevent any "noise" in the mattress which might otherwise arise as a consequence of the metal elements of the spring assembly contacting and moving relative to one another. This choice of materials and wrapping has been found to very nearly completely eliminate all noise problems which otherwise arise when the straps are made from metal and/or when the wire grid elements 33, 34 are not covered with a sound deadening material such as paper.

Figure 3:
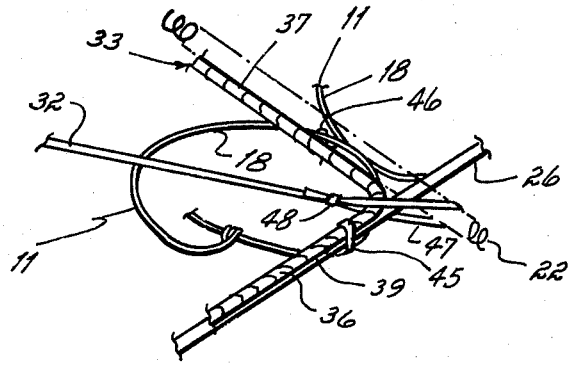
FIG. 3 is an exploded perspective view of the encircled portion of FIG. 1.

The grid assembly is attached to the coil spring matrix 29 by first attaching the grid elements 33, 34 to the matrix 29. This connection is made by attaching the web section 39 of each grid element 33, 34 to the inner border wire by means of conventional metal clips 45. The leg sections 38, 40, 41 and 37 of the grid element are then attached to the top surface of the mattress by hog rings 46 which wrap around overlapping segments of the top loops of adjacent coils and around a helical connector 22 which interconnects those loops. With the wire grid elements thus attached to the top surface of the mattress spring assembly, the plastic straps 32, 32' are worked beneath the grid element 33, 34 until they extend diametrically between opposed legs of the grid elements and overlie the top loops of the spring coils 11. As can be seen in FIG. 3, the ends of the straps are then wrapped around a section of the top loop 18 of a coil 11, a section of the helical wire 22 which connects adjacent coils, and a portion of one of the grid elements 33, 34. After being doubled back upon itself to form a closed loop 47, the end of the strap is secured in a looped fashion by a metal clip 48.

After a grid assembly 30 is attached to the top of a spring matrix 29, the spring matrix 29 is turned over and another identical grid assembly 30 is attached to the bottom surface of the mattress.

The provision of these grid assemblies 30 on the top and bottom surfaces of the mattress has the effect of firming the center one-third of the mattress which carries the greatest portion of the weight when a person is sleeping or reclining on the mattress. With this center section thus made more firm than the end sections, the head and shoulders of a person resting on the mattress are on a softer more comfortable part of the mattress while the heavier portion of the body is supported by a more firm section of the mattress.

While I have illustrated the invention as applied to a relatively large mattress, it is equally applicable to smaller mattresses, as for example twin size bed mattresses. In the case of twin bed size mattresses, only a pair of crossed straps are utilized rather than two pairs of straps as illustrated in the embodiment described hereinabove. These and other modifications and changes which may be made in the invention without departing from the spirit of my invention will be readily apparent to persons skilled in this art. Therefore, I do not intend to be limited except by the scope of the following appended claims:

I claim:

1. An improved mattress comprising, a coil spring matrix including a plurality of coil springs arranged in a matrix configuration having a plurality of transverse coil spring rows and a plurality of longitudinal coil spring columns, said transverse rows and longitudinal columns of coil springs having end loops interconnected by helical lacing wires, said end loops being located in and defining the top and bottom surfaces of said spring matrix, two grid assemblies sized to overlie a central one-third surface area of said coil spring matrix, one of said grid assemblies being located on the top surface of said mattress, and the other of said grid assemblies being located on the bottom surface of said mattress, each of said grid assemblies comprising, a pair of grid elements, each of said grid elements comprising a wire having a pair of opposed legs interconnected by a web section, the opposed legs of one grid element partially overlapping the opposed legs of the other grid element, said web section of each of said grid elements having a generally U-shaped offset formed therein, said offset having a pair of leg sections interconnected by a web section such that each of said grid elements is generally M-shaped in configuration, said legs of said grid elements extending parallel to said transverse rows of coil springs, and diagonally extending non-metallic straps located between the top surface of said coil spring matrix and said grid elements, said straps extending diagonally relative to said transverse rows and longitudinal columns of coil springs and being connected at their ends to said grid elements, and connector means connecting each of said grid elements to said end loops of said coil springs of said coil spring matrix.

2. The improved mattress of claim 1 wherein each of said grid elements has a paper coating adhered thereto.

3. The improved mattress of claim 2 in which said paper coating is helically wound on said wire grid elements.

* * * * *